US005140375A

United States Patent [19]

Shindo et al.

[11] Patent Number: 5,140,375

[45] Date of Patent: Aug. 18, 1992

[54] IMAGE FORMING APPARATUS

[75] Inventors: Yoshiko Shindo, Tachikawa; Jun-ichi Hamada, Fuchu; Yukio Okamoto, Hachioji, all of Japan

[73] Assignee: Konica Corporation, Tokyo, Japan

[21] Appl. No.: 794,008

[22] Filed: Nov. 19, 1991

[30] Foreign Application Priority Data

Nov. 23, 1990 [JP] Japan ..... 2-319949

[51] Int. Cl.[5] ..... G03G 21/00

[52] U.S. Cl. ..... 355/272; 355/311/326; 271/193

[58] Field of Search ..... 355/271, 272, 311, 210, 355/219, 326; 271/193

[56] References Cited

U.S. PATENT DOCUMENTS 5,049,937 9/1991 Takeda ..... 355/311 X 5,065,233 11/1991 Oka ..... 355/246

*Primary Examiner*—R. L. Moses

*Attorney, Agent, or Firm*—Finnegan, Henderson, Farabow, Garrett and Dunner

[57] ABSTRACT

The invention provides an apparatus for forming a toner image on plural types of recording materials. A transfer device includes a transfer belt to bring a recording material into contact with an imaging surface of photoreceptor so that the toner image is transferred to the recording material, and a charging device for charging the recording material carried on said transfer belt before the toner image is transferred to the recording material. The type of the recording material is detected and the charging device is controlled in accordance with the type of the recording material.

9 Claims, 6 Drawing Sheets

IMAGE FORMING APPARATUS

BACKGROUND OF THE INVENTION

The present invention relates to an image forming apparatus with a transfer belt device in which a transfer sheet for an image forming apparatus such as an electrophotographic copier is electrostatically supported and conveyed, a toner image on an image carrier is transferred onto the aforementioned transfer sheet by a physical means, and then the transfer sheet is conveyed to a fixing means.

FIG. 7 is a sectional view showing the structure of an embodiment of a conventional electrophotographic copier which is a conventional image forming apparatus. In the drawing, numeral 10 is a photoreceptor drum which is a drum-shaped image carrier, numeral 20 is a charger which charges the circumferential surface of the photoreceptor drum 10, numeral 30 is an exposure unit, numeral 13 is an image-exposure section, numeral 40 is a developing unit, numeral 50 is a transfer sheet supply unit, numeral 53 is a paper feed roller, P is a recording paper which is a transfer sheet, numeral 16 is a transfer unit which is a charger for transfer, numeral 17 is a separator which is a discharger for separation, by which paper is separated from the photoreceptor drum, numeral 80 is a fixing unit, numeral 90 is a cleaning unit, and numeral 56 is a conveyance belt which is a conveyance means for recording paper P.

Referring to the drawing, the operation of the aforementioned copier will be explained as follows. After the circumferential surface of the photoreceptor drum 10 has been uniformly charged by the charger 20, image exposure is conducted on the circumferential surface of the photoreceptor drum 10 by the exposure unit 30 at the image exposure section 13 so that an electrostatic latent image is formed. After that, the aforementioned latent image is developed by the developing unit 40 to be a visual toner image. This toner image is transferred onto recording paper P which is conveyed by a paper feed roller 53 of the transfer sheet supply unit 50 in synchronization with the aforementioned image formation. This transfer is conducted in such a manner that the recording paper P is charged from its back side by the transfer unit 16 to a polarity reverse to that of toner. After transfer has been completed, an AC high voltage is impressed by the separator 17 upon recording paper P so that it may be neutralized, thus the recording paper P can be separated from the photoreceptor drum 10. Separated recording paper P is conveyed by the conveyance belt 56 to the fixing unit 80, where the toner image formed on the recording paper is fixed, and then the recording paper is ejected onto a delivery tray provided outside the apparatus.

After the toner image has been transferred from the photoreceptor drum 10 onto the recording paper, the residual toner staying on the photoreceptor surface is removed by the cleaning unit 90 and the photoreceptor drum 10 stands by for the next copy cycle.

In the case of the aforementioned structure, however, it is necessary to adjust the discharging efficiency between the transfer unit 16 and the separator 17 to find out the optimum point for function for the purpose of ensuring the toner image transferability and separability, and yet the aforementioned discharging efficiency is greatly affected by the ambient conditions, and thus there is a problem of less latitude for reliability. The aforementioned transferability is affected by the electrical charge given to recording paper P and mechanical properties of recording paper P such as stiffness, surface smoothness and curl. These are largely fluctuated by the storage conditions of recording paper P and the environmental conditions such as temperature and humidity in a transfer operation, so that it is difficult to maintain the aforementioned factors in a good condition.

In the case where the diameter of the photoreceptor drum 10 is large, the force of the recording paper P wound around the drum 10 to revert to its initial flat shape is smaller than that in the case of the smaller diameter of the drum when recording paper P is transferred to the conveyance belt 56. Consequently, recording paper P onto which a toner image has been transferred, tends to stick to the surface of the photoreceptor drum 10 and thereby causes a jam, resulting in the lower papering property and lower reliability of the apparatus.

As technology to solve the aforementioned problems, a belt-shaped transfer and conveyance device shown in FIG. 8 has been disclosed in U.S Pat. No. 3,357,325.

In FIG. 8, numeral 10 is a photoreceptor drum which is a drum-shaped image carrier, numeral 70 is a transfer belt device which is a belt-shaped transfer and conveyance device, numeral 71 is a transfer belt which holds thereon an electric charge and attracts a transfer sheet, numerals 72, 73 are rollers around which a transfer belt 71 is supported and stretched and by which the transfer belt 71 is driven, numeral 60 is a pre-transfer paper charger which conducts corona-discharge in order to attract recording paper P onto the transfer belt 71 by an electrostatic force, numeral 16 is a transfer unit which is a charger for transferring a toner image from the photoreceptor drum 10 onto recording paper P, and numeral 160 is a transfer section. Due to the foregoing structure, recording paper P, while it is conveyed, can be strongly attracted to the surface of the transfer belt 71. Accordingly, transferability and separability can be improved in the transfer section.

The aforementioned transfer belt 70 is preferably used for a color image forming apparatus in which toner images are formed by superposing them on the photoreceptor drum 10 and transferred onto recording paper P at a time. In the conventional color image forming apparatus, toner images are superimposed on the photoreceptor drum 10, so that a plurality of developing units are provided around the circumferential portion of the photoreceptor drum 10, and therefore the diameter of the photoreceptor drum 10 is increased. Accordingly, the conventional electrostatic transfer separation system is not sufficient in separating a recording paper from the surface of the photoreceptor drum 10, so that more positive separability is required, and when toner images are superimposed, the amount of deposited toner is increased, so that a large amount of electrical charge for transfer is required, and therefore greater transfer-charge holding ability is required. From the aforementioned viewpoint, the aforementioned transfer belt device is superior to the conventional one.

In the image forming apparatus provided with the aforementioned transfer belt device, before the transfer of a toner image formed on the photoreceptor onto the transfer sheet, the transfer sheet is charged to the same polarity as that of toner on the photoreceptor, so that the transfer sheet is not attracted to the photoreceptor, and toner does not adhere to the transfer sheet unnecessarily. Accordingly, the transfer sheet is positively attracted to and held on the transfer belt and conveyed to the transfer section, and then the transfer sheet is charged to the polarity opposite to that of toner, so that the toner image or the photoreceptor is transferred and recorded on the transfer sheet.

There are following two types of charging as the aforementioned paper charging means for a transfer sheet. One of them is a charging type in which a charging electrode is provided and corona discharging is conducted. The other is a charging type in which voltage is impressed upon conductive material such as an elastic brush and then the conductive material is caused to come into contact with a transfer sheet. In the former type, the electrode is heavily soiled, and there is a tendency that the charging becomes uneven and insufficient due to uneven discharging. The later charging type utilizing an elastic brush is superior to the former on the aforementioned points.

However, in the case where the charging means utilizing the elastic brush is used, when a transparent sheet utilized for an over-head projector (OHP) is used as a transfer sheet, the sheet is made of a electrically insulating material, and therefore, the influence of the paper charging means remains when the image is transferred onto the sheet, and a longitudinal brush-shaped streak is made on the transferred toner image, resulting in remarkable deterioration of light permeability.

SUMMARY OF THE INVENTION

In view of the foregoing, inventors of the present invention have solved the aforementioned problems. As a result, it is a primary object of the present invention to provide an image forming apparatus in which conveyance property of a transfer sheet is superior and an image of high quality free from streaks and transfer unevenness can be transferred and recorded onto the transfer sheet even when the transfer sheet is not only a plain paper, but also a transfer sheet made of an electrically insulating material.

The above object is accomplished by an image forming apparatus in which a transfer sheet supplied onto a rotating transfer belt in synchronization with the transfer belt is charged by a paper charging means, and thereby attracted to and conveyed by the transfer belt, and after a toner image formed on an image carrier has been transferred onto the transfer sheet, the transfer sheet is separated from the transfer belt and then fixed, and which is characterized in that the aforementioned charging by means of the paper charging means is selectively conducted depending on the transfer sheet.

DETAILED DESCRIPTION OF THE PREFERRED EMBODIMENT

An example of the present invention is shown in FIG. 1 through FIG. 6.

Figure 1:
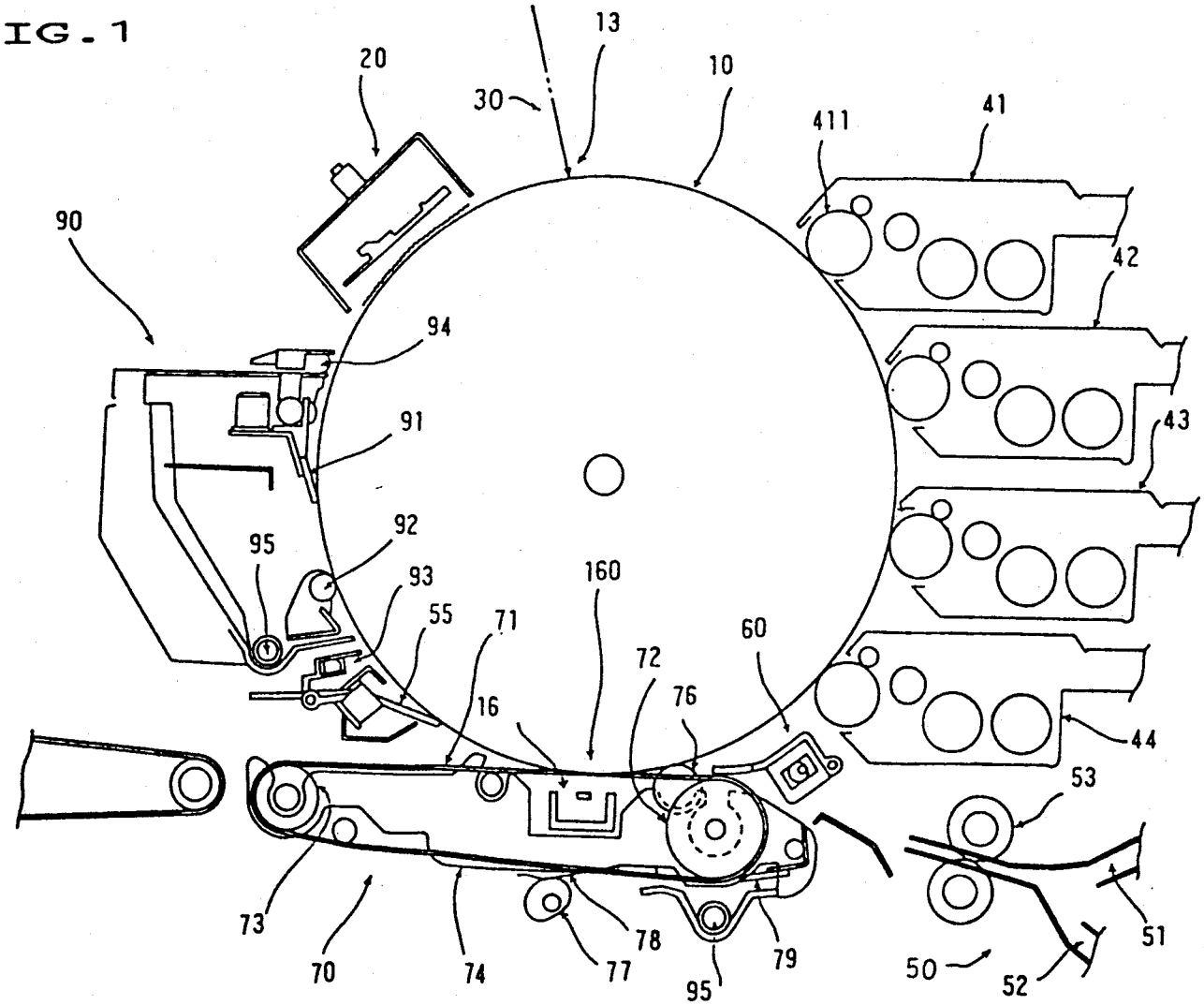
FIG. 1 is a sectional structural view of a color image forming apparatus of the present invention.

FIG. 1 is a sectional view showing the structure of an image forming apparatus of the present invention.

In the drawings, each of parts and components identical to those in a conventional image forming apparatus and transfer belt device 70 is given the same symbol, and its detailed explanation will be omitted because its operation is similar.

In FIG. 1, numeral 10 is a photoreceptor drum which is a drum-shaped image carrier, and the photoreceptor drum is coated with OPC photoreceptor that is grounded, and is driven to rotate clockwise. Numeral 20 is a scorotron charger which impresses the electric charge upon the photoreceptor coated around the circumferential surface of the aforementioned photoreceptor drum 10, and numeral 13 is an image exposure section on which an image exposure light or a laser beam is irradiated by an unillustrated optical exposure system so that an image can be focused on the circumferential surface of the photoreceptor drum 10.

A laser writing system unit is used as the aforementioned optical exposure system, for example. In the laser writing system unit, when a color signal outputted from an image reading apparatus, which is provided outside the aforementioned image forming apparatus, is inputted into the aforementioned laser writing system unit, a laser beam (wavelength is 780 nm) generated from a semiconductor laser is deviated for rotation scanning by a polygonal mirror, and its optical path is deviated by a reflection mirror through an $f\theta$ lens, and then the laser beam is projected on the circumferential surface of the photoreceptor drum 10 which has been uniformly charged in advance by the aforementioned charger 20.

On the other hand, when scanning is started, the laser beam is detected by an index sensor, modulation of the laser beam by the first color signal is started, and then the modulated laser beam scans the circumferential surface of the aforementioned photoreceptor drum 10. Accordingly, a latent image according to the first color is formed on an image section on the photoreceptor drum 10, through a primary scanning by the laser beam and a subsidiary scanning by the rotation of the photoreceptor drum 10. The latent image is developed by the method of reversal development by means of a developing means which contains, for example, yellow (Y) toner as the first color, and an yellow toner image is formed on the circumferential surface of the photoreceptor drum 10. While the toner image thus obtained on the image section is held on the circumferential surface of the photoreceptor drum 10, the toner image passes under a transfer means and a cleaning means which are separated from the circumferential surface of the photoreceptor drum 10, and then the apparatus enters the next copy cycle.

Namely, the aforementioned photoreceptor drum 10 is charged again by the aforementioned charger 20, the second color signal outputted from a signal processing unit is inputted into the aforementioned writing system unit, and then writing of the second color signal onto the circumferential surface of the photoreceptor drum 10 is conducted in the same way as in the aforementioned case of the first color signal, and a latent image is formed. The latent image is developed through the method of reversal development by means of a developing unit containing therein, for example, a magenta (M) toner as the second color, and a magenta toner image is formed. The magenta toner image is superposed on the aforementioned yellow toner image which has been already formed.

The toner image thus obtained on the image section passes, while it is held on the circumferential surface of the photoreceptor drum 10, under the transfer unit and the cleaning means which are staying away from the circumferential surface of the photoreceptor drum 10, and the apparatus enters the next copy cycle.

In the manner described above, writing of the third color signal is conducted onto the photoreceptor drum 10 and a latent image is formed thereon. The latent image is developed through the method of reversal development by means of the developing means containing therein, for example, a cyan toner as the third color. The cyan toner image is superposed on the aforementioned yellow and magenta toner images so that a color image can be obtained. Furthermore, when a developing means containing a black toner is provided as shown in the present example, and the black toner image is further superposed on other toner images, a color image with high image quality can be obtained.

Numerals 41 through 44 are developing units for the aforementioned development, which are the developing means each containing therein yellow, magenta, cyan, or black toner respectively, and they have similar structure to the other.

Figure 2:
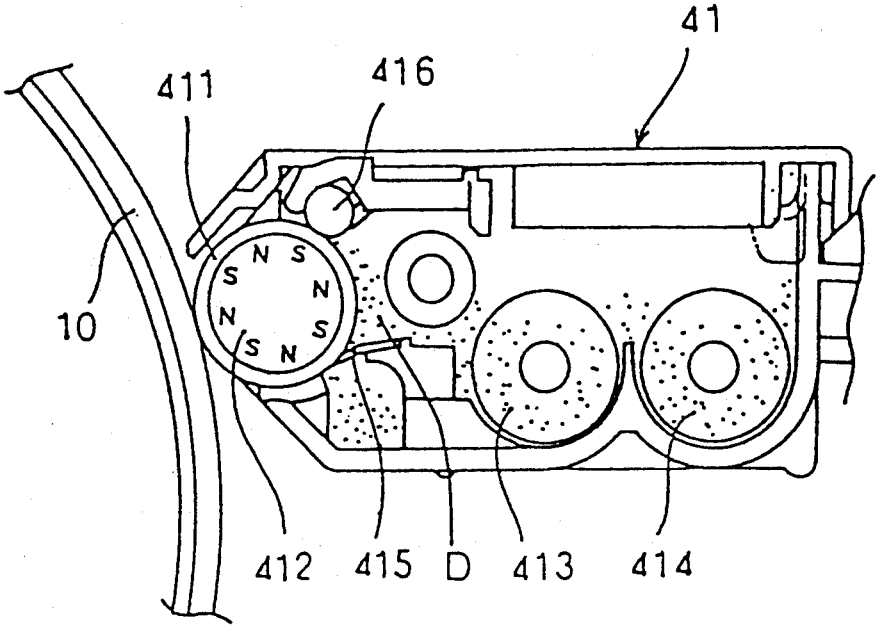
FIG. 2 is a sectional view of a developing unit of the aforementioned image forming apparatus.

FIG. 2 shows the structure of the developing unit 41. A developing sleeve 411, a magnet roller 412, stirring screws 413 and 414, and z scraping plate 415 and the like are provided in the developing unit 41. The distance between the developing sleeve 411 and the photoreceptor drum 10 is kept at about 0.5 mm constantly, through a roller (not shown in the drawing) which is coaxially provided on a shaft of the developing sleeve 411 and comes into contact with a non-image area of the circumferential surface of the photoreceptor drum 10.

Toner supplied from a toner containing device which is not shown in the drawing, is fully stirred and mixed with a magnetic carrier through the stirring screws 414 and 413 which are rotated in an opposite direction each other. Two-component developer D composed of the magnetic carrier and toner is stirred and mixed, and then it is supplied to the developing sleeve 411. The magnet roller 412 having fixed magnetic poles is provided in the developing sleeve 411, and a thin layer of developer D is formed by the developing sleeve 411 and the magnet roller 412.

A thin layer of developer D on the surface of the developing sleeve 411 is formed in a manner that: a developer thin layer forming means 416 which is a cylindrical rod made of magnetic material and provided oppositely to the magnetic poles of the magnetic roller 412, for example, is pressed to the developing sleeve 411; and thereby developer D is uniformly formed into a thin layer having the thickness of about 300 μm. Developing bias voltage is impressed upon the developing sleeve 411 so that a latent image on the image area on the photoreceptor drum 10 is developed. The thin layer of developer D on the developing sleeve 411 by which developing has been completed, is scraped off by the scraping plate 415, and a new thin layer of developer D is formed again through the aforementioned method.

Charging between the photoreceptor drum 10 and the charger 20 provided around the photoreceptor drum 10, exposure by the laser writing unit of each color, and the development processing by the developing units 41 through 44, are conducted for each color, namely 4 times in total, and a color toner image is formed on the image area on the circumferential surface of the photoreceptor drum 10 by superposing each toner image thereon.

Numerals 51 and 52 are paths of the transfer sheets which are fed one sheet by one sheet for each size from a transfer sheet supply device, and numeral 53 is a registration roller to convey a transfer sheet to the transfer section 160 in synchronization with the movement of the aforementioned color toner image on the photoreceptor drum 10.

Numeral 70 is a transfer belt device, numeral 71 is a transfer belt which is a belt section, numerals 72 and 73 are rollers made of conductive metallic material, wherein the roller 72 positioned upstream is caused to be grounded or kept at a predetermined potential which is close to the ground potential, and has a rotatable shaft, and the roller 73 positioned downstream has a fixed shaft and is used to drive the transfer belt 71. Numeral 74 is a belt supporting member one end of which is coaxially provided on the shaft of the roller 73 as a fixed shaft, and the other end of which is connected with a movable shaft of the roller 72, wherein the belt supporting member is pushed by an unillustrated elastic member to cause the roller 72 to be positioned downward. Normally (when transfer is not conducted), therefore, the transfer belt 71 is kept away from the circumferential surface of the photoreceptor drum 10, and when transfer is conducted, an eccentric cam 77 actuated by control of an apparatus control section pushes the belt supporting member 74 upwardly in the drawing through a leaf spring 78, and the belt supporting member 74 is rotated counterclockwise around the roller 73, and then rollers 76 provided on both side ends of the belt supporting member 74 come into contact with side edges of the non-image area on the circumferential surface of the photoreceptor drum 10 so that the transfer belt 71 comes into contact with the transfer section 160 of the photoreceptor drum 10.

Numeral 79 is a cleaning blade of a belt cleaning device which scrapes off a deposited toner on the transfer belt 71, numeral 95 is a toner conveyance pipe having therein a flexible conveyance screw which conveys the toner scraped off by the cleaning blade 79 to an unillustrated toner recovery box.

The aforementioned transfer belt 71 is structured as follows: the transfer belt is composed of two layers, for example; the belt main body is made of a high resistance sheet having volume resistivity of about $10^{10}$ Ω-cm in an endless-shape made of 0.5 to 1 mm thick silicone rubber, polyurethane rubber, butyl rubber, or the like; and fluorine resin, for example, is coated by spraying on the upper sheet so that the friction resistance can be lowered and soil adhesion can be prevented.

Numeral 16 is a transfer unit which is a transfer charger provided on the position facing the transfer section 160, numeral 60 is a sheet-charger which is a sheet-charging means for a transfer sheet positioned to face the transfer belt 71 wound around the roller 72 in the wedge-shaped space formed between the transfer belt 71 and the photoreceptor drum 10, numeral 61 is an elastic charging brush which is made of conductive fiber material and is provided in the sheet-charger 60, and numeral 66 is an electric power source which impresses bias voltage upon the charging brush 61. A protective resistor may be provided in series between the charging brush 61 and the power source 66 in order to prevent a large current which may flow when the charging brush 61 accidentally touches a grounded portion, or the like.

Figure 5A:
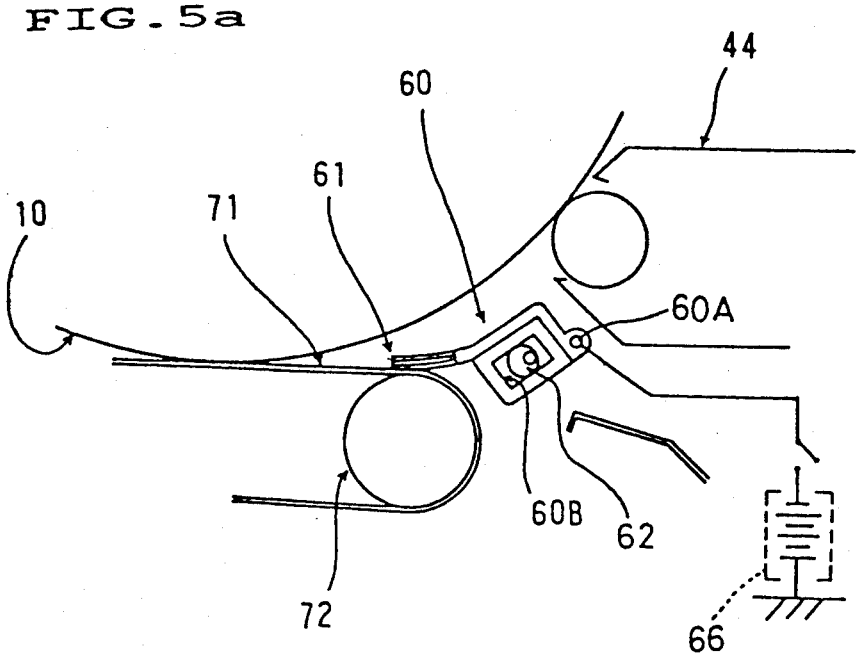
FIGS. 5*a* and 5*b* is a view showing the operation of a paper charger of the aforementioned apparatus.
Figure 5B:
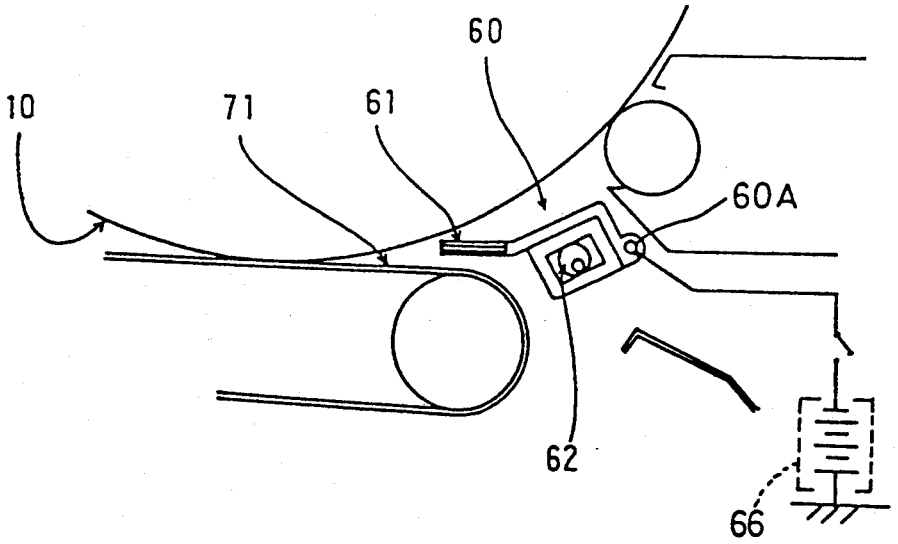

As shown in FIG. 5, the aforementioned sheet-charger 60 is rotatably supported with a fulcrum of a shaft 60A, and the charging brush 61 made of a conductive and elastic fiber material member is provided on the tip thereof.

Further, in the aforementioned sheet-charger 60, the charging brush can be operated as follows depending on the rotated phase of the eccentric cam 62 inscribed in square hole 60B: the tip of the aforementioned charging brush 61 is caused to elastically touch with pressure the circumferential surface of the transfer belt 71 which is in contact with the photoreceptor drum 10, at an angle shown in FIG. 5(*a*); or the sheet-charger 60 rotates clockwise, and the aforementioned charging brush 61 is caused to be withdrawn from the circumferential surface of the transfer belt 71 which is in contact with the photoreceptor drum 10, at an angle shown in FIG. 5(*b*). When the transfer belt 71 is away from the photoreceptor drum 10, the charging brush does not come into contact with the transfer belt 71 at any phase of the eccentric cam 62.

A wire made from stainless steel may be used as a conductive fiber material for the charging brush 61, but carbon-containing rayon with volume resistivity of $10^4$ to $10^6$ Ω·cm is used in the present example, resulting in a superior effect.

Figure 6:
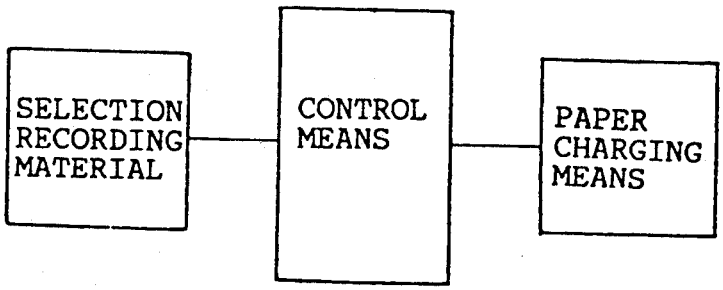
FIG. 6 is a control circuit diagram of the aforementioned paper changer.
Figure 7:
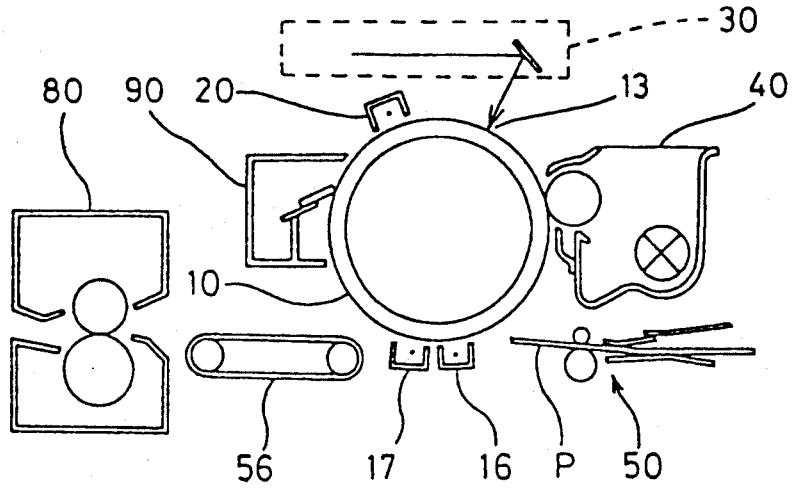
FIG. 7 is a sectional structural view showing the structure of a conventional electrophotographic copier.
Figure 8:
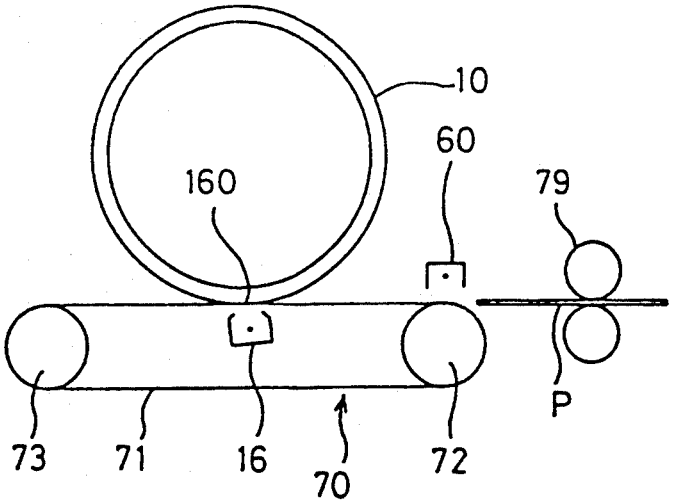
FIG. 8 is a schematic illustration showing an example of a conventional transfer belt device.

A rotating phase of the aforementioned eccentric cam 62 is selected and determined by a control circuit shown in FIG. 6.

Namely, the material of a transfer sheet is detected in advance whether it is a normal transfer paper, or an electrically insulating material such as the aforementioned transparent sheet. Transparency or air insulating property of a transfer sheet, or discrimination of a paper feed cassette in which a transfer sheet is contained, is used as a detection means. Of course, an operator may detect the kind of a transfer sheet.

When paper supply of a transfer paper as a transfer sheet is detected based on the aforementioned detection signal, the aforementioned eccentric cam 62 is rotated by the output of the control section, and the aforementioned sheet-charger 60 is caused to be under the condition shown in FIG. 5(*a*), and at the same time, a predetermined charging voltage is impressed upon the charging brush 61.

In this case, since bias voltage with same polarity as that of toner in developer is impressed upon the charging brush 61, toner on the photoreceptor drum 10 is not attracted to recording paper P until recording paper P arrives at the transfer section 160. Consequently, a sharp copy image with high quality can be obtained.

The bias voltage is controlled in a manner that: when moving linear velocity of the circumferential surface of the photoreceptor drum 10 is 140 mm/sec, image width is 300 to 350 mm, and thickness of a paper is 65 g/mz, constant-voltage control is made so that bias voltage may be controlled to be 0.5 to 2.0 KV (the same polarity as that of toner).

On the other hand, when supply of a transparent sheet is detected, the aforementioned eccentric cam 62 is further rotated to be at angles shown in FIG. 5(*b*) with the charger 60, and charging voltage for the charging brush 61 is not impressed.

In the example explained above, the charging brush 61 is moved corresponding to a transfer sheet to be charged. It is also allowable, however, that the charging brush 61 is always in contact with the transfer sheet which is being conveyed and impresses or does not impress thereon the voltage, depending on the kind of the transfer sheet.

Figure 3:
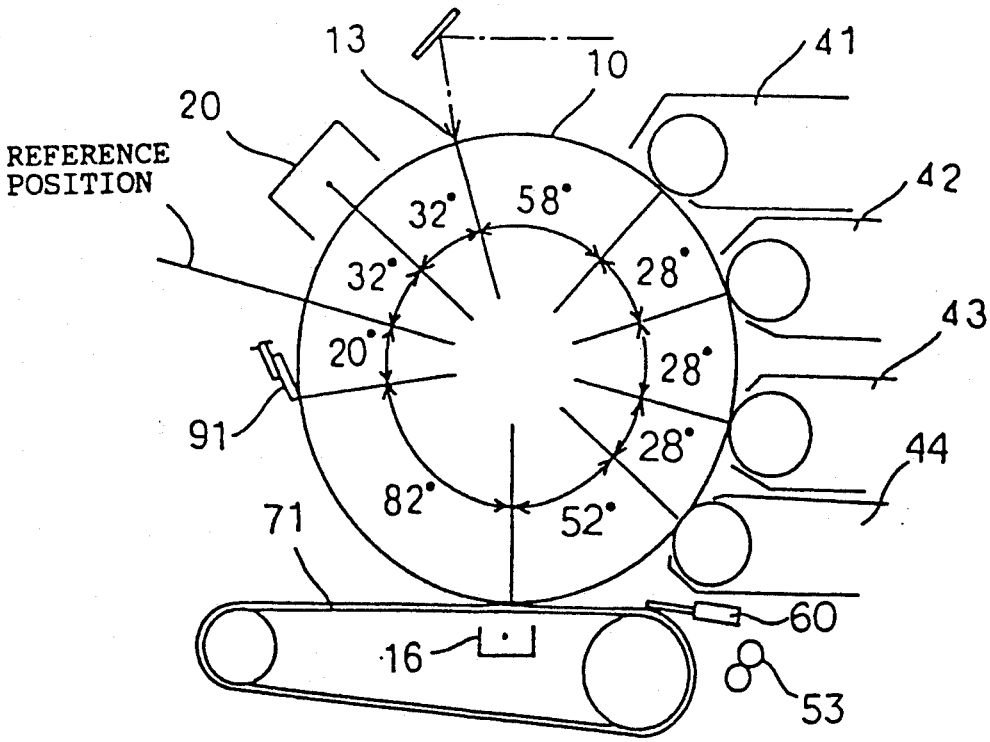
FIG. 3 is an illustration showing a positional relation of each image forming means.
Figure 4:
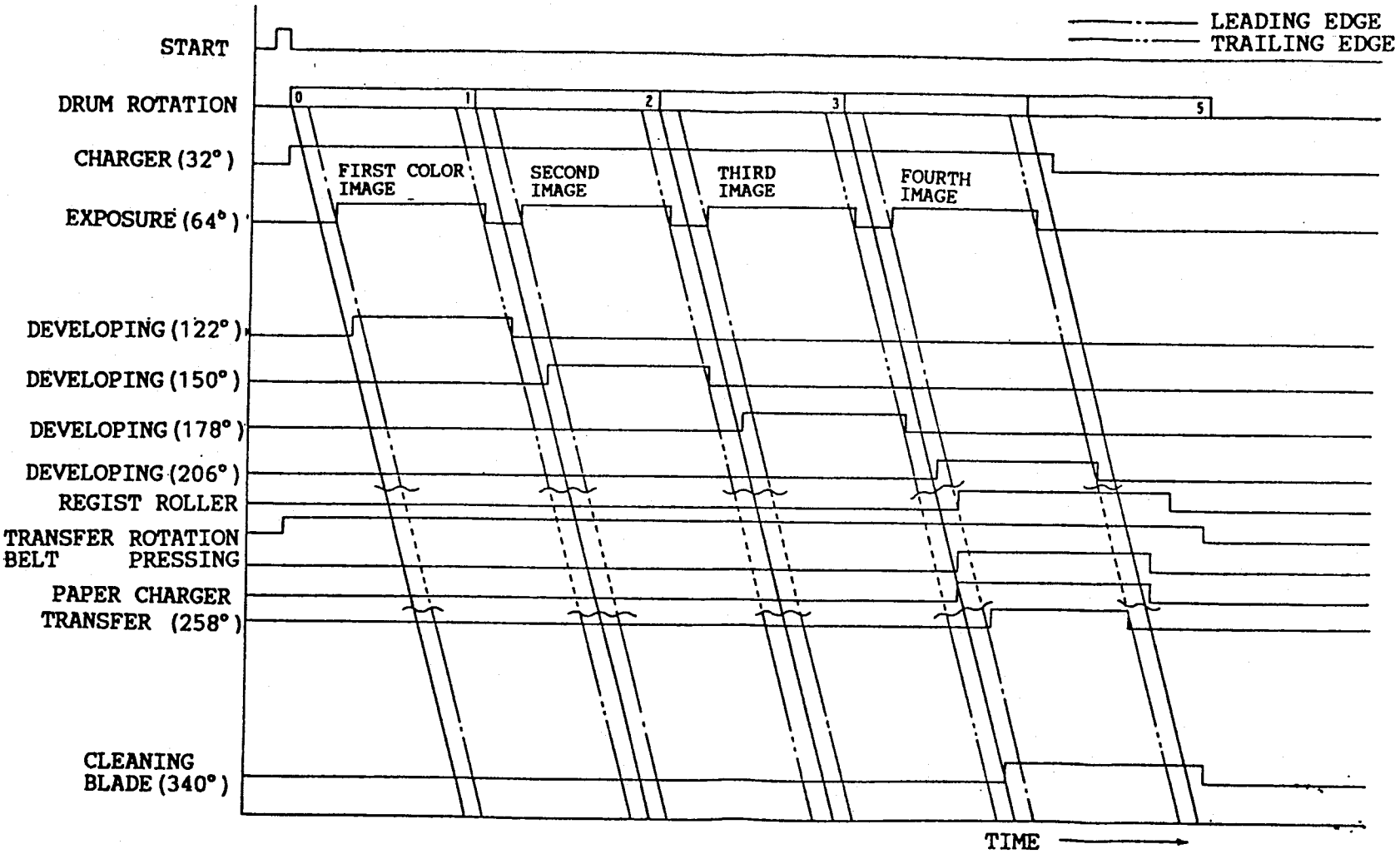
FIG. 4 is a time chart showing the image forming process.

In the image forming apparatus shown in FIG. 1, each image forming means is positioned around the photoreceptor drum 10 in a positional relation shown in FIG. 3, and the image forming process is controlled by a control sequence in a time chart shown in FIG. 4. FIG. 4 shows a copying process of a transfer paper.

Namely, after development by the developing unit 44 in which toner of the fourth color is contained has been started on the photoreceptor drum 10 as described above, the registration roller 53 is driven, and the transfer belt 71 comes into contact with the photoreceptor drum 10 with pressure. When a transfer paper is fed, the charging brush 61 in the aforementioned sheet-charger 60 comes into contact with the transfer paper and the voltage is impressed upon it. On the other hand, when a transparent sheet is fed, the charging brush 61 is withdrawn.

As a result, in the case of the transfer paper, the transfer paper is charged by the aforementioned sheet-charger 60 to the same polarity as that of toner on the photoreceptor drum 10 and thereby strongly attracted to the transfer belt 71 so that the transfer paper can be conveyed to the transfer section 160 integrally with the transfer belt. In the case of a transparent sheet having electric insulation property, it is electrostatically attracted to the transfer belt 71 even if the transparent sheet is not charged by the charging brush 61, and conveyed to the transfer section 160, resulting in an image with superior light-permeability having no streak and transfer unevenness.

When the leading edge of the transfer sheet has reached the transfer section 160, the transfer sheet is caused to touch the photoreceptor drum 10 with pressure by the transfer belt 71. Then, the transfer unit 16 charges the transfer sheet to the polarity opposite to that of the toner on the photoreceptor drum 10, so that the aforementioned toner image may be transferred onto the transfer sheet. The transfer sheet onto which the toner image has been transferred, is further conveyed by the transfer belt 71, and reaches a fixing section not shown in the drawing so that the toner image thereon can be fixed by thermal adhesion, and then ejected onto a paper delivery tray provided outside the apparatus. Numeral 55 is a separation claw which prevents the recording paper from advancing upward accidentally.

The photoreceptor drum 10 from which image transfer has been completed by turning and pressing of the aforementioned transfer belt 71 and charging action of the transfer unit 16, is cleaned by the cleaning device 90. The cleaning device 90 has a cleaning blade 91 as a cleaning means, a toner recovery roller 92 which electrostatically collects the residual toner, and the like. While the toner image is formed on the circumferential surface of the photoreceptor drum 10, the aforementioned cleaning blade 91 is in its withdrawn position, and after transfer has been completed, the cleaning blade 91 touches the photoreceptor drum 10 with pressure so that cleaning can be conducted. Further, a discharge lamp 93 is positioned on the upstream side of the cleaning device 90, and a discharge lamp 94 is positioned on the downstream side of the cleaning device 90. The discharge lamp 93 discharges the residual toner on the photoreceptor drum 10 to be easily removed. The discharge lamp 94 uniformly discharges the circumferential surface of the photoreceptor drum 10 so that uniform charging can be performed thereon. A toner conveyance pipe 95 having a toner conveyance screw made of flexible material is provided on the bottom portion of the cleaning device 90, and thus the waste toner collected through cleaning is conveyed to a toner collection box not shown in the drawing. The photoreceptor drum 10 on which the aforementioned cleaning has been completed, enters the next image forming process.

The present invention is to provide an image forming apparatus having various uses in which an image that is free from unevenness and fog and is excellent in light-permeability, can be always stably transferred onto not only a normal transfer paper but also an electric insulating transfer sheet such as a transparent sheet used in an over-head projector or the like.

In the present invention, a conductive charging brush is preferably used as a sheet-charger, however, a charger of a corona discharging type may also be used as a sheet-charger.

What is claimed is:

1. An apparatus for forming a toner image on plural types of recording materials, comprising:

image carrying means having an imaging surface on which a toner image is formed;

means for transferring the toner image from said imaging surface to a recording material, including a transfer belt for carrying the recording material thereon to bring the recording material into contact with said imaging surface so that the toner image is transferred to the recording material, and charging means for charging the recording material carried on said transfer belt before the toner image is transferred to the recording material;

means for detecting the type of the recording material and for outputting a signal representing the type of the recording material; and control means for receiving the signal and for controlling said charging means in accordance with the type of the recording material.

2. The apparatus of claim 1, wherein said charging means is adapted to come in contact with the recording material carried on said transfer belt, thereby a charging electric voltage is applied onto the recording material.

3. The apparatus of claim 2, wherein said control means controls said charging means so that the charging electric voltage is selectively switched on or off in accordance with the type of the recording material.

4. The apparatus of claim 2, wherein said control means controls said charging means so that the charging electric voltage is variable in accordance with the type of the recording material.

5. The apparatus of claim 3, wherein said control means controls said charging means not to apply the charging electric voltage onto the recording material when the recording material is made of an electrically insulating material.

6. The apparatus of claim 2, wherein said charging means is further adapted to move away from the recording material, and wherein said control means controls said charging means to selectively come in contact with or move away from the recording material in accordance with the type of the recording material.

7. The apparatus of claim 5, wherein said control means controls said charging means to move away from the recording material when the recording material is made of an electrically insulating material.

8. The apparatus of claim 1, wherein said charging means is a charging brush.

9. The apparatus of claim 7, wherein said electric insulating material is a transparent sheet

* * * * *